US009079282B2

(12) United States Patent
Moore et al.

(10) Patent No.: US 9,079,282 B2
(45) Date of Patent: Jul. 14, 2015

(54) CENTER LAP TOOL MACHINE FOR LARGE TRANSMISSION GEARS

(75) Inventors: Royce Moore, Decatur, TX (US); Monte Smith, Arlington, TX (US); Richard Pae, Arlington, TX (US); Greg Turner, Burleson, TX (US)

(73) Assignee: Textron Innovations Inc., Providence, RI (US)

( * ) Notice: Subject to any disclaimer, the term of this patent is extended or adjusted under 35 U.S.C. 154(b) by 246 days.

(21) Appl. No.: 13/641,410

(22) PCT Filed: Dec. 29, 2010

(86) PCT No.: PCT/US2010/062343

§ 371 (c)(1),
(2), (4) Date: Oct. 15, 2012

(87) PCT Pub. No.: WO2012/091703

PCT Pub. Date: Jul. 5, 2012

(65) Prior Publication Data

US 2013/0029565 A1 Jan. 31, 2013

(51) Int. Cl.

| | |
|---|---|
| ***B24B 5/01*** | (2006.01) |
| ***B24B 9/00*** | (2006.01) |
| ***B24B 27/00*** | (2006.01) |
| ***B24B 41/06*** | (2012.01) |
| ***B24D 5/06*** | (2006.01) |

(52) U.S. Cl.
CPC ..... *B24B 9/00* (2013.01); *B24B 27/0007* (2013.01); *B24B 27/0076* (2013.01); *B24B 41/067* (2013.01); *B24D 5/06* (2013.01)

(58) Field of Classification Search
CPC ..... B24B 5/01; B24B 5/06; B24B 5/08; B24B 5/10; B24B 27/0007; B24B 41/067; B24D 5/06
USPC ..... 451/51, 61, 180, 190, 194, 231, 262
See application file for complete search history.

(56) References Cited

U.S. PATENT DOCUMENTS 1,816,090 A * 7/1931 Page ..... 451/65
3,458,961 A * 8/1969 Henry-Biabaud ..... 451/470

(Continued)

FOREIGN PATENT DOCUMENTS

DE 1089663 9/1960
DE 2127298 6/1971

(Continued)

OTHER PUBLICATIONS

English language machine translation of DE2127298.*

(Continued)

*Primary Examiner* — Maurina Rachuba
(74) *Attorney, Agent, or Firm* — James E. Walton; Richard G. Eldredge

(57) ABSTRACT

A machine system and method for simultaneously lapping a first machining surface of a hollow shaft and an opposing second machining surface of the hollow shaft, the machine system having a brake subsystem for securing the hollow shaft in a relatively stationary position while a drive subsystem rotates a lapping tool within the hollow shaft such that the lapping tool laps the first machining surface with an abrasive surface of a top lap while simultaneously lapping the second machining surface with an abrasive surface of a bottom lap.

11 Claims, 5 Drawing Sheets

(56) References Cited

U.S. PATENT DOCUMENTS

| | | | | | |
|---|---|---|---|---|---|
| 3,686,797 | A | * | 8/1972 | Taylor | 451/157 |
| 4,679,357 | A | * | 7/1987 | Richter et al. | 451/21 |

FOREIGN PATENT DOCUMENTS

| | | | | |
|---|---|---|---|---|
| DE | 2127298 | * | 12/1972 | B24B 9/04 |
| DE | 102007000208 | | 10/2007 | |
| EP | 1916057 | | 4/2008 | |

OTHER PUBLICATIONS

European Search Report dated Apr. 23, 2014 from counterpart EP App. No. 10861248.2.

European Search Report dated Oct. 17, 2013 from counterpart EP App. No. 10861248.2.

Office Action dated Jul. 9, 2014 from counterpart CA App. No. 2,821,059.

International Search Report and the Written Opinion of the International Searching Authority mailed by ISA/USA, U.S. Patent and Trademark Office on Jun. 6, 2011 for International Patent Application No. PCT/US2010/062343, 8 pages.

European Search Report dated Oct. 10, 2014 from counterpart EP App. No. 10861248.2.

Chinese Office Action dated Dec. 25, 2014 from counterpart CN App, No. 201080070811.9.

* cited by examiner

CENTER LAP TOOL MACHINE FOR LARGE TRANSMISSION GEARS

TECHNICAL FIELD

The present application relates generally to machining systems, and more particularly, to a lapping machine system.

DESCRIPTION OF THE PRIOR ART

Lapping is a machining operation in which a working surface is contoured with an abrasive tool. The lapping process is an effective machining process in creating smooth contoured surfaces, and in the transmission industry, the lapping process is utilized for truing two or more machining surfaces of a large transmission gear. For example, conventional transmissions include large bull gears for meshing with one or more pinion gears. The bull gear typically includes a hollow cylindrical shaft extending through the base center axis, the shaft having at least two machining surfaces that are "trued" to each other during the lapping process for mounting the bull gear on other machining systems.

Conventional lapping methods include manually applying an abrasive material, i.e., sandpaper, to the machining surfaces. For example, a worker first secures the bull gear to a mounting support, applies sandpaper to the first machining surface to create a desired contour, then removes the bull gear from the mounting support and repeats the process on a second machining surface. The manual process significantly decreases the workers ability to maintain the required surface tolerances, thereby failing to true both machining surfaces relative to each other. Furthermore, the process is time consuming, resulting in wasted time and money.

Another conventional method includes lapping the machining surfaces with a lathe machine. The bull gear rotatably couples to the lathe machine for lapping the first machining surface. Thereafter, the worker removes bull gear and repeats the setup and lapping operation on the second machining surface. The lathe machining operation requires the worker to lap each machining surface individually, which can result in undesired results such as cranking. Furthermore, the process is time consuming, i.e., the worker is required to perform two set-ups, a first set-up for lapping the first machining surface and a second set-up for lapping the second machining surface.

Although the foregoing developments represent great strides in the area of machine lapping a bull gear, many shortcomings remain.

BRIEF DESCRIPTION OF THE DRAWINGS

The novel features believed characteristic of the application are set forth in the appended claims. However, the application itself, as well as a preferred mode of use, and further objectives and advantages thereof, will best be understood with reference to the following detailed description when read in conjunction with the accompanying drawings, wherein:

Figure 1:
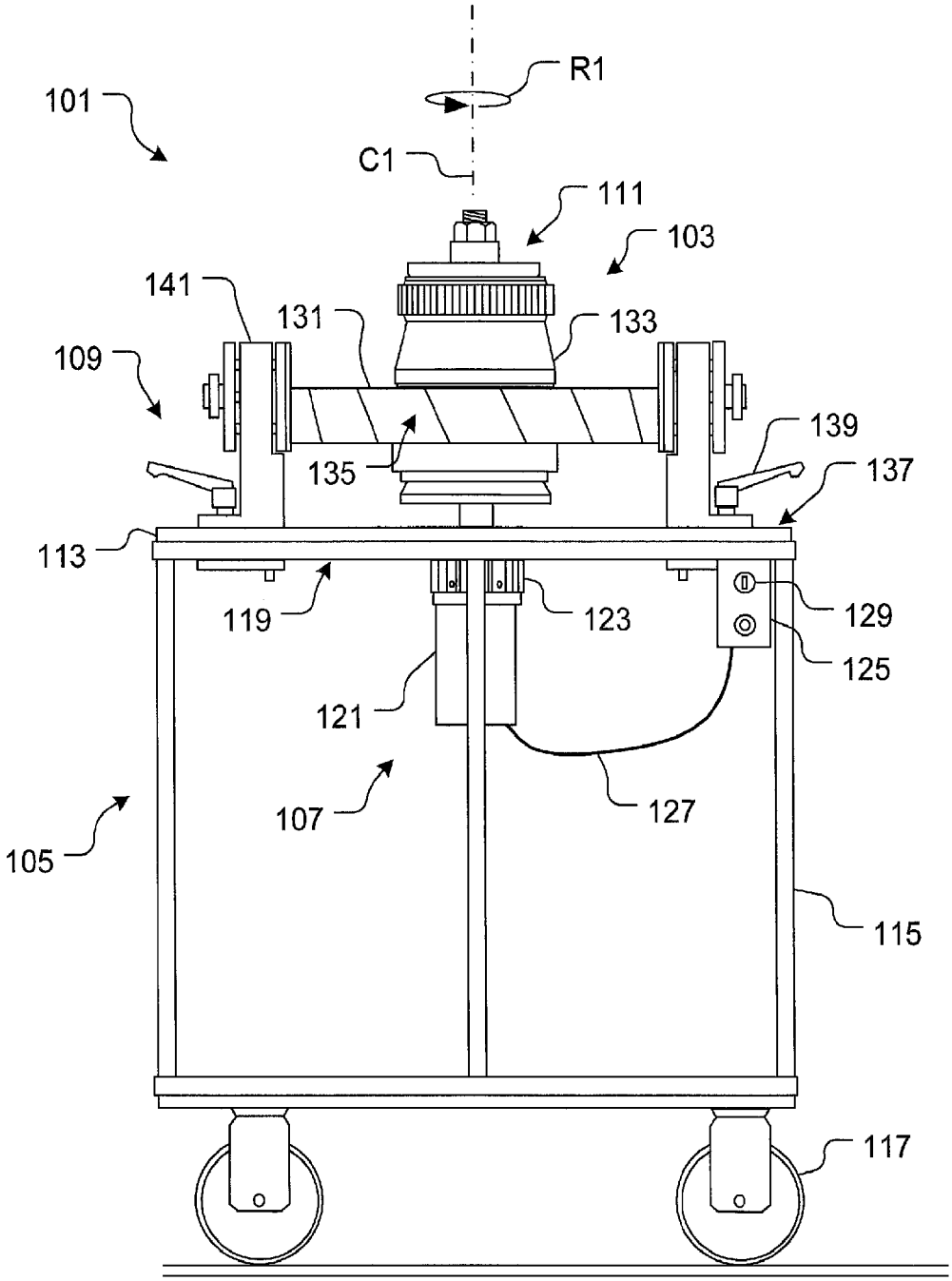
FIG. 1 is a front view of a machine system according to the preferred embodiment of the present application.

While the machine system of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DESCRIPTION OF THE PREFERRED EMBODIMENT

The machine system of the present application overcomes common disadvantages associated with conventional methods and devices for simultaneously lapping two machining surfaces of a transmission gear. Specifically, the machine system includes a lapping tool rotatably coupled to a work station and braking subsystem for supporting and maintaining the gear in a stationary position while the lapping tool extends through a hollow shaft of the gear and provides simultaneous abrasive lapping on both the upper and lower machining surfaces of the gear.

The machine system of the present application will be understood, both as to its structure and operation, from the accompanying drawings, taken in conjunction with the accompanying description. Several embodiments of the machine system and components are presented herein. It should be understood that various components, parts, and features of the different embodiments may be combined together and/or interchanged with one another, all of which are within the scope of the present application, even though not all variations and particular embodiments may be specifically illustrated in each figure.

Referring now to FIG. 1 in the drawings, a front schematic view of a machine system 101 according the preferred embodiment of the present application is shown. FIG. 1 illustrates machine system 101 operably associated with a bull gear 103; however, it should be appreciated that machine system 101 is readily and easily adaptable for use with other types of gears, hollow shafts, and other conduits or devices wherein simultaneous, concentric abrasive lapping of two machining surfaces is required. Machine system 101 preferably comprises one or more of a mobile structure 105, a drive subsystem 107, a brake subsystem 109, and a lapping tool 111 to perform the lapping operation.

Mobile structure 105 carries and transports the various components of machine system 101 and bull gear 103 during the lapping operation. Mobile structure 105 preferably includes a work table 113 having one or more grooves, holes, slots, and/or other surface arrangements for adjustably receiving brake subsystem 109. For example, bull gears are typically manufactured in different shapes and sizes, thereby requiring brake subsystem 109 to be positioned at different locations on table 113 for accommodating the various embodiments of bull gear 103. Thus, brake subsystem 109 is provided with one or more devices for securely coupling to the grooves, holes, slots, and/or other surface arrangements of table 113.

In the preferred embodiment, table 113 is manufactured with one or more different types of metallic materials, i.e., a steel or aluminum alloy, for providing sufficient carrying support and rigidity for drive subsystem 107, brake subsystem 109, lapping tool 111, and bull gear 103. However, it should be appreciated that alternative embodiments of table 113 could include other materials, i.e., wood, composite, plastic, or other suitable materials, in lieu of or in addition to the preferred material.

Mobile structure 105 further comprises a rigid support frame 115 adapted to support table 113 and to provided sufficient height for a worker to easily operate machine system 101. Frame 115 can also provide adequate storage space for carrying additional subsystems and other components of machine system 101, i.e., power cables or replacement components. One or more wheels 117 are rotatably attached to the bottom of frame 115 for facilitating easy and rapid mobility of machine system 101.

Drive subsystem 107 provides the necessary driving means for rotating lapping tool 111 within bull gear 103 in the rotational direction R1 about a center axis C1. Drive subsystem 107 is preferably held in a fixed position to a bottom surface 119 of table 113. In the preferred embodiment, drive subsystem 107 comprises one or more of a motor 121, a transmission 123 and a control station 125.

Transmission 123 includes one or more intermeshing gears (not shown) for reducing the rotational speed of an input shaft (not shown) from motor 121. In the preferred embodiment, motor 121 directly couples to transmission 123; however, it should be appreciated that alternative embodiments could include a motor adapted to directly couple to lapping tool 111. Also, an alternative embodiment could include the control station having the necessary circuitry, i.e, a variable frequency drive, for controlling the rotational speed of motor 121; thus, eliminating the need for transmission 123.

Control station 125 electrically connects to motor 121 via a conductor 127. Additional conductors (not shown) electrically couple to control station 125 for channeling electrical energy from an electrical power source (not shown) to control station 125. In the preferred embodiment, control station 125 is provided alternating current (AC) electrical energy from a conventional AC outlet; however, it should be appreciated that a direct-current power source from batteries or other suitable sources could be used in lieu of the preferred embodiment.

Control station 125 includes one or more processors, switches, and other necessary circuitry for controlling drive subsystem 107. In the preferred embodiment, control station 125 includes at least one switch 129 for controlling motor 121. It should be appreciated that control station 125 could include the necessary circuitry for fully automating the lapping process. In addition, control station 125 could include an adjustable timer adapted to allow electrical energy to motor 121 for a predetermined duration of time.

Brake subsystem 109 securely holds bull gear 103 in a relatively stationary position during the lapping operation. Bull gear 103 comprises a cylindrical base 131, a hollow shaft 133, and a set of teeth 135 extending from the peripheral edge of base 131. Lapping tool 111 is adapted to fit within shaft 133 and abrasively contacts the upper and lower machining surfaces of shaft 133 (see FIG. 6C). Bull gears come in different shapes and sizes, thereby requiring brake subsystem 109 to be adjustably fastened to a top surface 137 of table 113 with one or more fastening means 139. In the preferred embodiment, brake subsystem 109 comprises at least two structures 141 for securing bull gear 103 in a stationary position; however, it should be appreciated that alternative embodiments could include a single structure 141 or other suitable types of structures for holding bull gear 103 in the stationary position.

Figure 2:
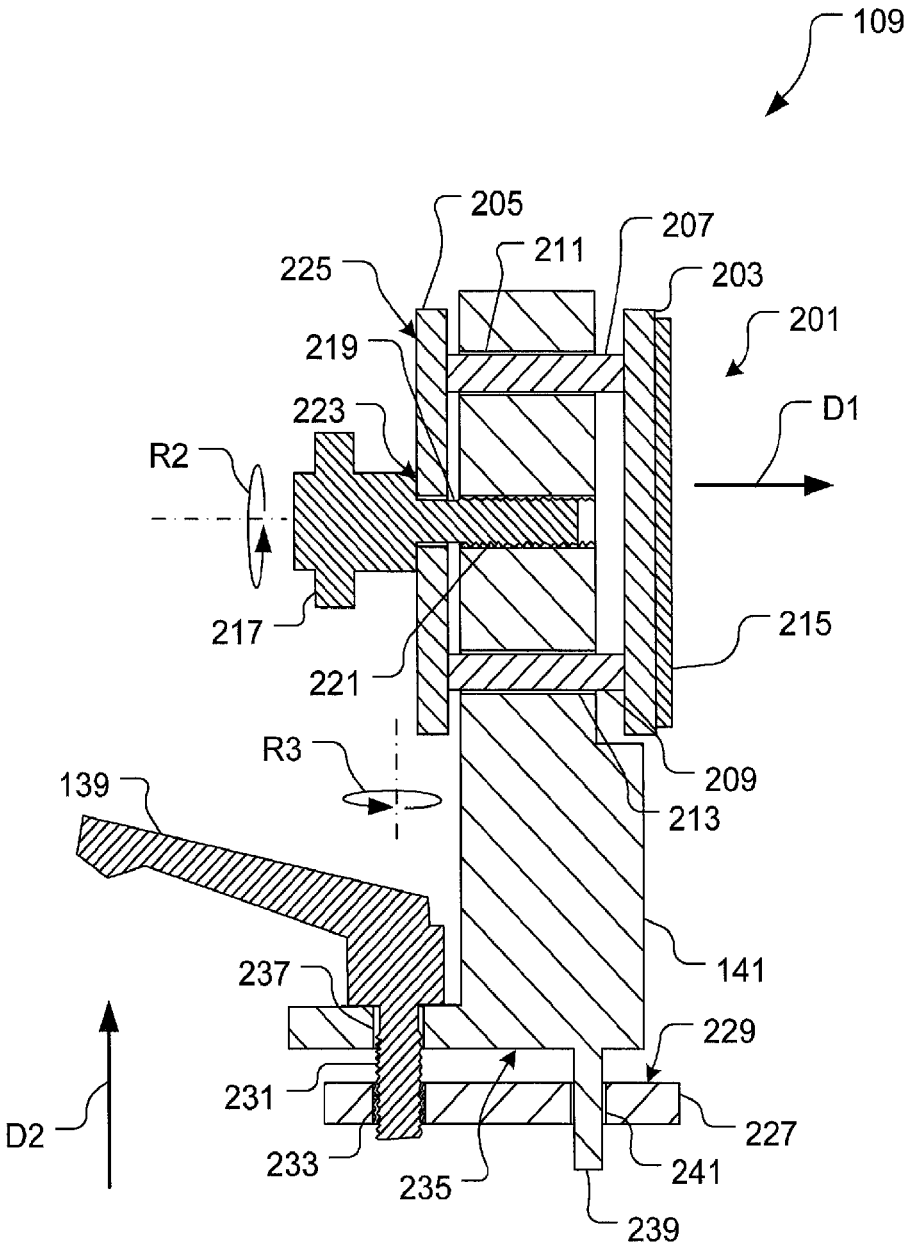
FIG. 2 is front cross-sectional view of a brake subsystem of FIG. 1.

Referring now to FIG. 2 in the drawings, a front cross-sectional view of brake subsystem 109 is shown. Brake subsystem 109 comprises an adjustable brake 201 slidingly engaged to structure 141. Brake 201 includes a first member 203 extending relatively parallel to a second member 205, the two members being interconnected with a first rod 207 and a second rod 209, which pass through respective first slot 211 and second slot 213 extending through structure 141. During setup, brake 201 moves in a direction D1 and securely abuts against teeth 135 of bull gear 103.

Brake 201 is further provided with an optional brake pad 215 for engaging with teeth 135. Brake pad 215 is preferably composed of a phenolic resin material; however, it should be appreciated that alternative embodiments of brake pad 215 could include other types of suitable materials such as rubber metal, wood, composite, or combinations thereof for engaging teeth 135. In addition, alternative embodiments could include pads having surface treatments such as etches, grooves, dimples, and/or other surface contouring for increasing the surface friction between bull gear 103 and brake pad 215. Furthermore, alternative embodiments of brake pad 215 could also include one or more sets of mating teeth for intermeshing with teeth 135.

Brake subsystem 109 is further provided with a first handle 217 for securing brake 201 against base 131 of bull gear 103 and is also provided with fastening means 139, i.e., a handle, for securing structure 141 in a fixed position on surface 137 of table 113. It should be appreciated that an alternative embodiment of brake subsystem 109 could include other fastening means in lieu of handle 217 and fastening means 139 for securing brake subsystem 109 and bull gear 103 in a stationary position. For example, an alternative embodiment could include a snap, clip, worm gear, quick-release device, and/or other suitable device, either manually or autonomously utilized, for securing brake subsystem 109 and bull gear 103 in the stationary position.

Handle 217 includes a threaded shaft portion 219 for engaging with a threaded conduit 221 extending through structure 141. The intermeshing threads between shaft 219 and conduit 221 create locking means for securing brake 201 in a fixed position. Handle 217 includes a surface 223 for abutting against surface 225 of member 205. During setup, a worker rotates handle 217 in rotational direction R2, thereby pushing surface 223 against surface 225 in a direction D1, which in turn securely abuts brake pad 215 against base 131 of bull gear 103.

Brake subsystem 109 further includes a member 227 for securing brake subsystem 109 in a stationary position on table 113. Member 227 includes a surface 229 adapted to abut against surface 119 of table 113. Fastening means 139 comprises a threaded shaft portion 231 for engaging with a threaded conduit 233 disposed within member 227. Threaded shaft 231 is adapted to extend through a hole, slot, groove, and/or other suitable surface arrangement on table 113 and provides locking means between the intermeshing threads for securing brake subsystem 109 in a fixed position on table 113.

During setup, a surface 235 of structure 141 is placed on surface 137 of table 113, shaft 231 is placed within conduit 237 of structure 141 and is threadedly received in conduit 233, then fastening means 139 is rotated in a rotational direction R3, which in turn causes member 227 to move in a direction D2, thereby resulting in surface 235 and surface 229 being snugly fit against respective surface 137 and surface 119 of table 113.

Structure 141 is further optionally provided with one or more members 239 for adding stability and support to brake subsystem 109 while fastened to table 113. Member 239 is adapted to extend through a hole, slot, groove, and/or other suitable surface arrangement on table 113 and is adapted to extend through a conduit 241 disposed within member 227. Shaft 231 and member 239 enable brake subsystem 109 to be positioned at various locations on table 113.

Figure 3C:
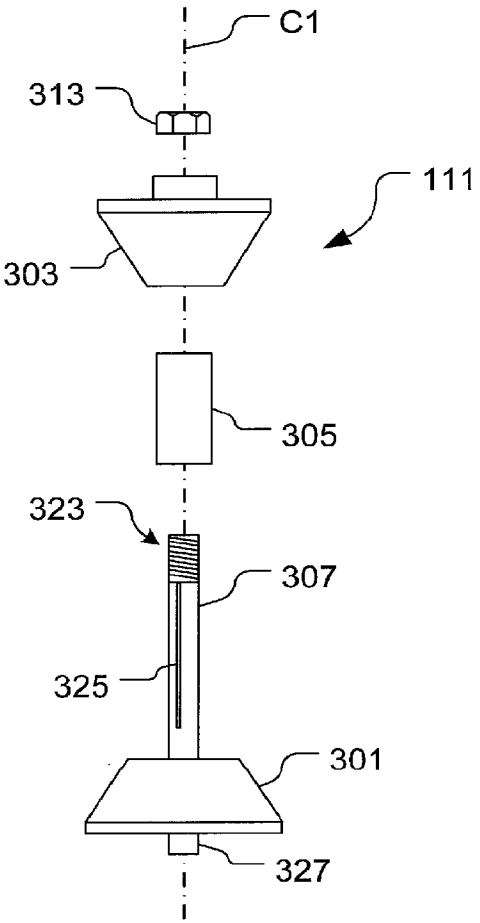
FIG. 3C is an exploded front view of the lapping tool of FIG. 3A.
Figure 3B:
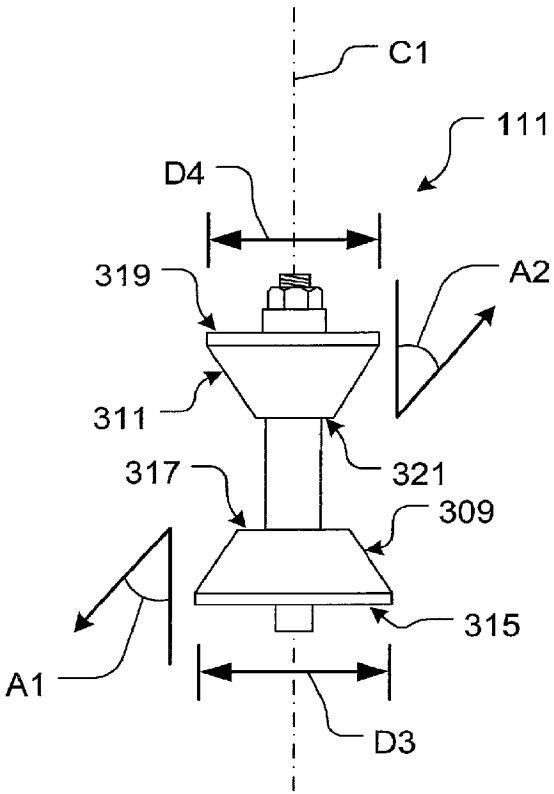
FIG. 3B is a front view of the lapping tool of FIG. 3A.
Figure 3A:
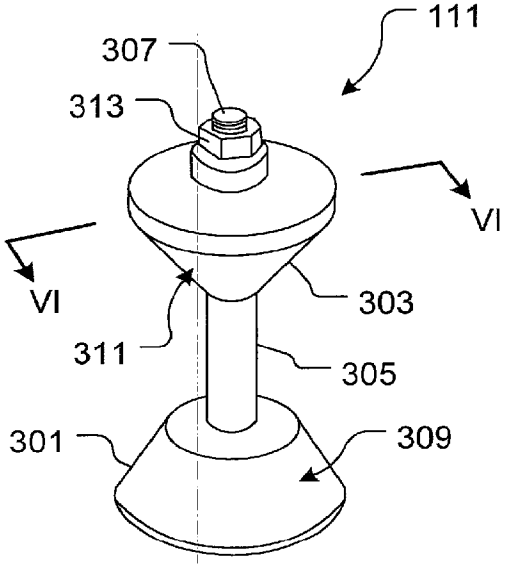
FIG. 3A is an oblique view of a lapping tool of FIG. 1.

Referring now to FIGS. 3A-3C in the drawings, various schematic views of lapping tool 111 are shown. FIG. 3A shows an oblique view of lapping tool 111; FIG. 3B shows a front view of lapping tool 111; and, FIG. 3C shows an exploded front view of the lapping tool 111.

Figure 6C:
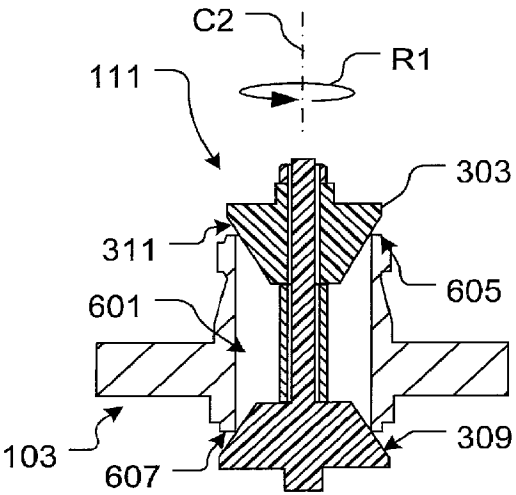
FIGS. 6A-6C are front cross-sectional views of the lapping tool of FIG. 3A taken at VI-VI and shown operably associated with a front cross-sectional view of a bull gear.

Lapping tool 111 is utilized for simultaneously machining both a top and bottom machining surfaces of bull gear 103 (see FIG. 6C). Lapping tool 111 overcomes the disadvantages associated with conventional methods and devices for lap machining a bull gear, namely, lapping tool 111 machines both top and bottom machining surfaces simultaneously; whereas conventional methods, including manual application of an abrasive material or a lathe machine, are time consuming and fail to provide simultaneous machining of both surfaces, resulting in cranking, wasted time, increased costs, and uneven machining surfaces.

Lapping tool 111 comprises one or more of a bottom center lap 301, a top center lap 303, an optional spacer 305, and an arbor 307. Both bottom center lap 301 and top center lap 303 include respective abrasive surface 309 and abrasive surface 311 for contact with the machining surfaces of bull gear 103. In the preferred embodiment, abrasive surface 309 and abrasive surface 311 are composed of a cubic boron nitride material; however, it should be appreciated that alternative embodiments could include other types of suitable abrasive materials in lieu of the preferred embodiment. In addition, it should be appreciated that alternative embodiments could include abrasive surface treatments, i.e., etches, grooves, dimples, in lieu of or in addition to the preferred embodiment.

Abrasive surface 309 extends at an angle A1 with respect to center axis C1 and abrasive surface 311 extends at an angle A2 with respect to the center axis C1. In the preferred embodiment, both angle A1 and angle A2 are 30 degree; however, it should be appreciated that alternative embodiments could include different angles in lieu of the preferred angles. For example, an alternative embodiment could require the machining surfaces to have 45 degree angles for coupling with other machine systems in lieu of machining surfaces having 30 degree angles.

In the preferred embodiment, abrasive surface 309 linearly extends from a surface 315 to a surface 317 of bottom center lap 301 and abrasive surface 311 linearly extends from a surface 319 to a surface 321 of top center lap 303. However, it should be appreciated that alternative embodiment could include different contoured surface shapes including convex, concave, and other geometric surfaces in lieu of the preferred linear profile.

FIG. 3B shows surface 315 having a diameter D3 and surface 319 having a diameter D4. In the preferred embodiment, diameter D3 is equal to diameter D4; however, it should be appreciated that alternative embodiments could include a top and a bottom center lap having different diameters. It should be understood that hollow shaft 133 of bull gear 103 could include a first opening having a diameter larger or smaller than the opposing second opening. For this reason, bottom center lap 301 and top center lap 303 are adapted to have different diameters for fitting the openings of hollow shaft 133.

FIG. 3C shows lapping tool 111 as an exploded view, wherein the various components of lapping tool 111 are detached from each other. In the preferred embodiment, bottom center lap 301 is rigidly attached to a center arbor 307, which receives and supports top center lap 303. Arbor 307 is further provided with a threaded portion 323 for threadedly engaging with nut 313. A key slot 325 extends partially the longitudinally length of arbor 307 and is adapted for mating with a key (not shown) disposed within top center lap 303.

It should be understood that alternative embodiments of bull gear 103 include hollow shafts with different longitudinal lengths. For this reason, lapping tool 111 is further provided with an optional spacer 305, which is adapted to slide on arbor 307 and is utilized for spacing apart top center lap 303 from bottom center lap 301 at a predetermined distance. Lapping tool 111 preferably includes one or more spacers having different longitudinal lengths; however, it should be appreciated that alternative embodiments could include an arbor adapted to securely hold top center lap 303 in a fixed positioned without the use of spacer 305. For example, arbor 307 could include an edge, slot, groove or other suitable surface treatment or device for spacing apart top center lap 303 from bottom center lap 301.

Lapping tool 111 is further provided with an attachment device 328 for coupling lapping tool 111 to drive subsystem 107. In the preferred embodiment, attachment device 319 is a hollow shaft adapted to matingly engage with an output shaft (not shown) of drive subsystem 107.

During assembly, a worker slides spacer 305 on arbor 307, then aligns and slides top center lap 303 on arbor 307 such that that the top center lap key (not shown) aligns and slide within key slot 325, finally, the worker secures top center lap 303 in position by fastening nut 313 to threaded portion 323.

Figure 4:
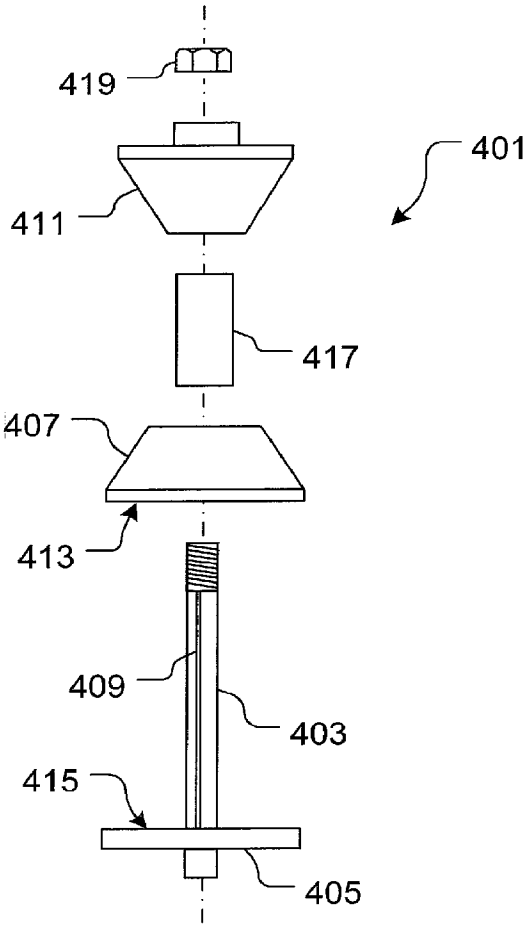
FIG. 4 is an exploded front view of an alternative embodiment of the lapping tool of FIG. 3C.

Referring now to FIG. 4 in the drawings, an alternative embodiment of lapping tool 111 is shown. Lapping tool 401 is substantially similar in form and function to lapping tool 111; however, lapping tool 401 is further provided with an arbor 403 having a platform 405 for receiving and supporting a detachable bottom center lap 407.

During assembly, a worker aligns and slides bottom center lap 407 on arbor 403 such that the bottom center lap tool key (not shown) aligns and slide within key slot 409. It should be noted that key slot 409 travels the length of arbor 403 in this embodiment and receives the keys in both bottom center lap 407 and a top center lap 411. Bottom center lap 407 is slid down arbor 403 until a surface 413 of bottom center lap 407 rests on surface 415 of platform 405. Thereafter, the worker slides spacer 417 and top center lap 411 on arbor 403 and securely fastens the components of lapping tool 401 with a nut 419.

Figure 5:
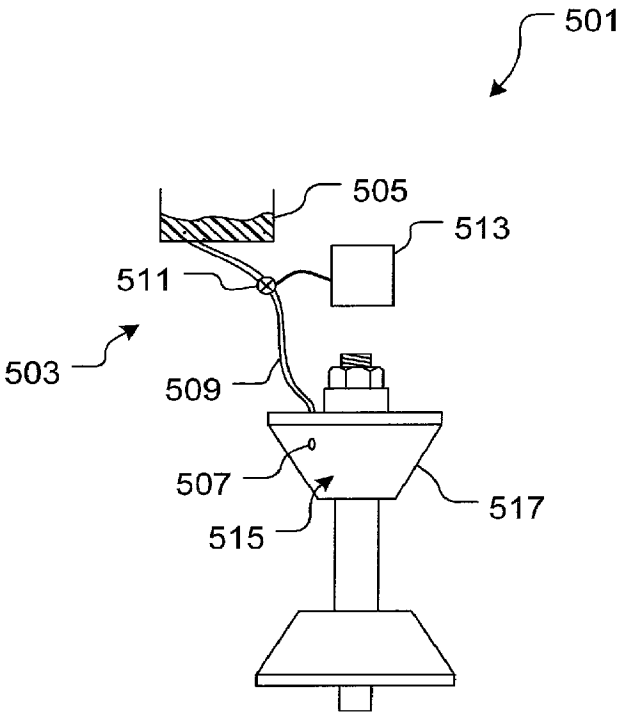
FIG. 5 is a front view of an alternative embodiment of the lapping tool of FIG. 3A.

Referring now to FIG. 5 in the drawings, an alternative embodiment of lapping tool 111 is shown. Lapping tool 501 is substantially similar in form and function to lapping tool 111; however, lapping tool 501 is further provided with a lubrication subsystem 503 comprising a lubricant reservoir 505, a port 507, and a conduit 509 in fluid communication with reservoir 505 and port 507. Lubricant subsystem 503 can also be provided with an optional valve 511 and a control system 513 operably associated with valve 511 for controlling the amount of lubricant traveling from reservoir 505 to port 507. During operation, lubricant from reservoir 505 channels through conduit 509 and exits through port 507. Lubricate subsystem 503 is adapted to provide lubricant to surface 515 of top center lap 517, which helps maintain a desired surface temperature and finish during the lapping process.

Figure 6B:
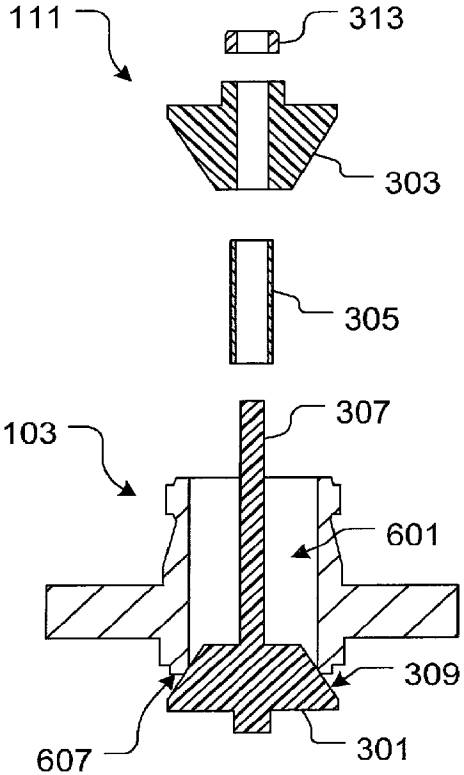
Figure 6A:
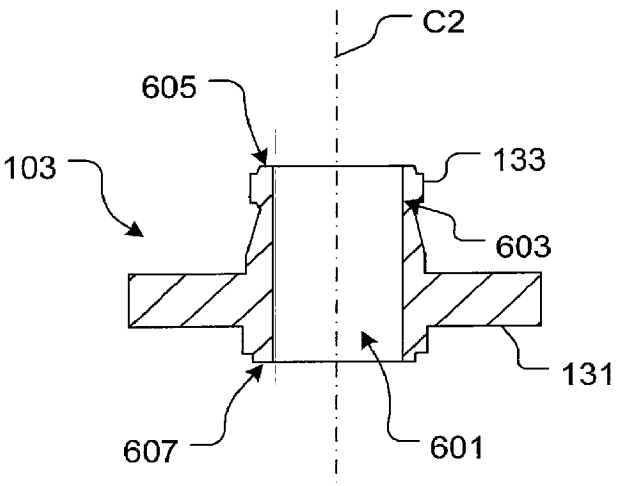

Referring now to FIGS. 6A-6C in the drawings, front cross-sectional views of lapping tool 111 are shown during the assembly and operation processes. FIG. 6A shows a front cross-sectional view of bull gear 103 comprising an inner hollow conduit 601 having an inner surface 603 and a center axis C2. Bull gear 103 is further provided with an upper surface 605 and a lower surface 607.

FIG. 6B shows lapping tool 111 disassembled and in preparation for assembly within conduit 601. During the assembly process, bull gear 103 is positioned on bottom center lap 301 such that surface 607 comes into contact with abrasive surface 309 of bottom center lap 301. Thereafter, spacer 305 and top center lap 303 are slid on arbor 307 and securely fastened in position with nut 313. Finally, base 131 of bull gear 103 is secured in a stationary position with brake subsystem 109 (see FIG. 1). It should be noted that when assembled properly, center axis C2 of bull gear 103 remains concentric with center axis C1 of lapping tool 111.

FIG. 6C shows lapping tool 111 assembled within conduit 601 of bull gear 103. When assembled, abrasive surface 311 of top center lap 303 contacts surface 603 of bull gear 103 and abrasive surface 309 of bottom center lap 301 contacts surface 607 of bull gear 103. During operation, the worker activates motor 121 via switch 129, which in turn rotates lapping tool 111 in a rotational direction R1 within conduit 601, causing both surface 309 and surface 311 of lapping tool 111 to abrasively machine respective surface 607 and surface 603 of bull gear 103, resulting in a surface finish of surface 603 being true to a surface finish of surface 607.

It is evident by the foregoing description that the machine system has significant benefits and advantages over conventional lapping machining devices. For example, the machine system includes a lapping tool rotatably coupled to a work station and braking subsystem for supporting and maintaining the gear in a stationary position while the lapping tool extends through a hollow shaft of the gear and provides simultaneous abrasive lapping on both the upper and lower machining surfaces of the gear. The machine system overcomes problems associated with conventional lapping processes, namely, the machine system saves time and money exhausted in truing the two machining surfaces relative to each other.

The particular embodiments disclosed above are illustrative only, as the invention may be modified and practiced in different but equivalent manners apparent to those skilled in the art having the benefit of the teachings herein. It is therefore evident that the particular embodiments disclosed above may be altered or modified, and all such variations are considered within the scope and spirit of the invention. Accordingly, the protection sought herein is as set forth in the description. It is apparent that an invention with significant advantages has been described and illustrated. Although the present invention is shown in a limited number of forms, it is not limited to just these forms, but is amenable to various changes and modifications without departing from the spirit thereof.

The invention claimed is:

1. A machine system for simultaneously lapping a first machining surface of a hollow shaft and an opposing second machining surface of the hollow shaft, the machine system comprising:

a support structure;

an adjustable brake subsystem carried by the support structure, the brake subsystem being configured to apply force against an outer surface of the hollow shaft in a direction perpendicular to a center axis of the hollow shaft;

a lapping tool carried by the support structure, the lapping tool being adapted to extend within the hollow shaft, the lapping tool having:

a central arbor having a first end portion and a second end portion, the first end portion being spaced apart from the second end portion;

a removable top lap coupled to the first end portion, the top lap having an abrasive surface, the abrasive surface being adapted for contact with the first machining surface of the hollow shaft and an inner surface of the hollow shaft; and a bottom lap coupled to the second end portion, the bottom lap having an abrasive surface, the abrasive surface being adapted for contact with the second machining surface of the hollow shaft and the inner surface of the hollow shaft; and a drive subsystem carried by the support structure and rotatably coupled to the lapping tool;

wherein the brake subsystem secures the hollow shaft in a relatively stationary position and the drive subsystem rotates the lapping tool within the hollow shaft for lapping the first machining surface with the abrasive surface of the top lap while simultaneously lapping the second machining surface with the abrasive surface of the bottom lap; and wherein the first machining surface and the second machining surface extend relatively parallel to each other, and the inner surface extending relatively perpendicular to the first machining surface.

2. The machine system according to claim 1, wherein the hollow shaft extends through the center of a bull gear.

3. The machine system according to claim 1, wherein a center axis of the hollow shaft coaxially aligns with a center axis of the lapping tool.

4. The machine system according to claim 1, wherein the support structure is portable.

5. The machine system according to claim 1, wherein the brake subsystem comprises:

a structure;

a brake slidingly carried by the support structure; and a fastening device coupled to the support structure;

wherein the fastening device is adapted to retain the structure in a fixed position on the support structure and the brake is adapted to secure the hollow shaft in a relatively stationary position.

6. The machine system according to claim 1, wherein the drive subsystem comprises:

a motor rotatably coupled to the lapping tool; and a control station electrically connected to the motor, the control station being adapted to control the rotational speed of the motor.

7. The machine system according to claim 6, wherein the control station includes a timer for activating the drive subsystem for a predetermine amount of time.

8. A method of simultaneously truing a first machining surface of a hollow shaft relative to a second machining surface of the hollow shaft, the method comprising:

securing the hollow shaft in a stationary positioned with a force exerted against an outer surface of the hollow shaft with a brake subsystem;

providing a lapping tool having:

a central arbor having a first end portion and a second end portion, the first end portion being spaced apart from the second end portion;

a removable top lap coupled to the first end portion, the top lap having an abrasive surface, the abrasive surface being adapted for contact with the first machining surface of the hollow shaft and an inner surface of the hollow shaft;

a bottom lap coupled to the second end portion, the bottom lap having an abrasive surface, the abrasive surface being adapted for contact with the second machining surface of the hollow shaft and the inner surface of the hollow shaft;

assembling the lapping tool within the hollow shaft; and driving the lapping tool with a drive subsystem;

wherein the brake subsystem secures the hollow shaft in a relatively stationary position and the drive subsystem rotates the lapping tool within the hollow shaft for lapping the first machining surface with the abrasive surface of the top lap while simultaneously lapping the second machining surface with the abrasive surface of the bottom lap.

9. The method according to claim 8, further comprising:

coaxially aligning a center axis of the hollow shaft with a center axis of the lapping tool.

10. The method according to claim 8, further comprising:

spacing the top tap and the bottom tap with a spacer slidingly such that a predetermined distance is formed therebetween.

11. The method according to claim 8, further comprising:

lubricating the abrasive surface of the top lap with a lubricant with a lubrication subsystem.

* * * * *